US007569132B2

(12) United States Patent
Dolan

(10) Patent No.: US 7,569,132 B2
(45) **Date of Patent: *Aug. 4, 2009**

(54) PROCESS FOR ANODICALLY COATING AN ALUMINUM SUBSTRATE WITH CERAMIC OXIDES PRIOR TO POLYTETRAFLUOROETHYLENE OR SILICONE COATING

(75) Inventor: Shawn E. Dolan, Sterling Heights, MI (US)

(73) Assignee: Henkel KGaA (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/972,592

(22) Filed: Oct. 25, 2004

(65) Prior Publication Data

US 2005/0115840 A1 Jun. 2, 2005

Related U.S. Application Data

(63) Continuation-in-part of application No. 10/162,965, filed on Jun. 5, 2002, now Pat. No. 6,916,414, which is a continuation-in-part of application No. 10/033,554, filed on Oct. 19, 2001, now abandoned, which is a continuation-in-part of application No. 09/968,023, filed on Oct. 2, 2001, now abandoned.

(51) Int. Cl.
*C25D 11/06* (2006.01)
*C23C 28/00* (2006.01)

(52) U.S. Cl. ..... 205/107; 205/108; 205/201; 205/324

(58) Field of Classification Search ..... 205/201, 205/107, 108, 324
See application file for complete search history.

(56) References Cited

U.S. PATENT DOCUMENTS

| | | | | |
|---|---|---|---|---|
| 2,231,372 | A | 2/1941 | Schenk | |
| 2,305,669 | A | 12/1942 | Budiloff et al. | |
| 2,880,148 | A | 3/1959 | Evangelides | |
| 2,901,409 | A | 8/1959 | DeLong | |
| 2,926,125 | A | 2/1960 | Currah et al. | |
| 3,345,276 | A | 10/1967 | Munroe | |
| 3,524,799 | A * | 8/1970 | Dale | 205/330 |
| 3,620,940 | A | 11/1971 | Wick | |
| 3,824,159 | A | 7/1974 | Wehrmann | |
| 3,945,899 | A | 3/1976 | Nikaido et al. | |
| 3,956,080 | A | 5/1976 | Hradcovsky et al. | |
| 3,960,676 | A | 6/1976 | Miyosawa et al. | |
| 3,996,115 | A | 12/1976 | Kessler | |
| 4,082,626 | A | 4/1978 | Hradcovsky | |
| RE29,739 | E | 8/1978 | Kessler | |
| 4,110,147 | A * | 8/1978 | Grunwald et al. | 156/307.5 |
| 4,166,777 | A | 9/1979 | Casson, Jr. et al. | |
| 4,184,926 | A | 1/1980 | Kozak | |
| 4,188,270 | A | 2/1980 | Kataoka | |
| 4,227,976 | A | 10/1980 | Menke | |
| 4,370,538 | A | 1/1983 | Browning | |
| 4,383,897 | A | 5/1983 | Gillich et al. | |
| 4,399,021 | A | 8/1983 | Gillich et al. | |
| 4,439,287 | A | 3/1984 | Birkle et al. | |
| 4,448,647 | A | 5/1984 | Gillich et al. | |
| 4,452,674 | A | 6/1984 | Gillich et al. | |
| 4,455,201 | A | 6/1984 | Birkle et al. | |
| 4,551,211 | A | 11/1985 | Kobayashi et al. | |
| 4,578,156 | A | 3/1986 | Plazter | |
| 4,620,904 | A | 11/1986 | Kozak | |
| 4,659,440 | A | 4/1987 | Hradcovsky | |
| 4,668,347 | A | 5/1987 | Habermann et al. | |
| 4,744,872 | A | 5/1988 | Kobayashi et al. | |
| 4,839,002 | A | 6/1989 | Pernick et al. | |
| 4,859,288 | A | 8/1989 | Furneaux et al. | |
| 4,869,789 | A | 9/1989 | Kurze et al. | |
| 4,869,936 | A | 9/1989 | Moskowitz | |
| 4,976,830 | A | 12/1990 | Schmeling et al. | |
| 4,978,432 | A | 12/1990 | Schmeling et al. | |
| 5,087,645 | A * | 2/1992 | Kojima et al. | 523/406 |
| 5,221,576 | A * | 6/1993 | Bosc et al. | 428/327 |
| 5,240,589 | A | 8/1993 | Bartak et al. | |
| 5,264,113 | A | 11/1993 | Bartak et al. | |
| 5,266,412 | A | 11/1993 | Bartak et al. | |
| 5,275,713 | A | 1/1994 | Hradcovsky | |
| 5,281,282 | A | 1/1994 | Dolan et al. | |
| 5,302,414 | A | 4/1994 | Alkhimov et al. | |
| 5,385,662 | A | 1/1995 | Kurze et al. | |
| 5,470,664 | A | 11/1995 | Bartak et al. | |

(Continued)

FOREIGN PATENT DOCUMENTS

DE 28 90 65 A5 4/1991

(Continued)

OTHER PUBLICATIONS

U.S. Appl. No. 10/297,594, filed Oct. 25, 2004, Dolan, Co-pending case.

(Continued)

*Primary Examiner*—Patrick Ryan
*Assistant Examiner*—William T Leader
(74) *Attorney, Agent, or Firm*—Mary K. Cameron

(57) ABSTRACT

An article of manufacture and a process for making the article by the anodization of aluminum and aluminum alloy workpieces to provide corrosion-, heat- and abrasion-resistant ceramic coatings comprising titanium and/or zirconium oxides, and the subsequent coating of the anodized workpiece with polytetrafluoroethylene ("PTFE") or silicone containing coatings. The invention is especially useful for forming longer life PTFE coatings on aluminum substrates by precoating the substrate with an anodized layer of titanium and/or zirconium oxide that provides excellent corrosion-, heat- and abrasion-resistance in a hard yet flexible film.

42 Claims, No Drawings

U.S. PATENT DOCUMENTS

| | | | | |
|---|---|---|---|---|
| 5,700,366 | A | 12/1997 | Steblianko et al. | |
| 5,775,892 | A | 7/1998 | Miyasaka et al. | |
| 5,792,335 | A | 8/1998 | Barton | |
| 5,811,194 | A | 9/1998 | Kurze et al. | |
| 5,837,117 | A | 11/1998 | Allegret | |
| 5,958,604 | A | 9/1999 | Raibkov et al. | |
| 5,981,084 | A | 11/1999 | Riabkov et al. | |
| 6,059,897 | A | 5/2000 | Koerner et al. | |
| 6,082,444 | A | 7/2000 | Harada et al. | |
| 6,127,052 | A * | 10/2000 | Tomari et al. | 428/680 |
| 6,153,080 | A | 11/2000 | Heimann et al. | |
| 6,159,618 | A | 12/2000 | Danroc et al. | |
| 6,197,178 | B1 | 3/2001 | Patel et al. | |
| 6,280,598 | B1 | 8/2001 | Barton et al. | |
| 6,335,099 | B1 | 1/2002 | Higuchi et al. | |
| 6,372,115 | B1 | 4/2002 | Miyasaka et al. | |
| 6,797,147 | B2 * | 9/2004 | Dolan | 205/316 |
| 6,861,101 | B1 | 3/2005 | Kowalsky et al. | |
| 6,863,990 | B2 | 3/2005 | Wu et al. | |
| 6,869,703 | B1 | 3/2005 | Spitsberg et al. | |
| 6,875,529 | B1 | 4/2005 | Spitsberg et al. | |
| 6,916,414 | B2 * | 7/2005 | Dolan | 205/316 |
| 2003/0000847 | A1 | 1/2003 | Ostrovsky | |
| 2003/0070935 | A1 | 4/2003 | Dolan | |

FOREIGN PATENT DOCUMENTS

| | | | |
|---|---|---|---|
| DE | 41 04 847 | | 8/1992 |
| EP | 1002644 | A2 | 5/2000 |
| EP | 0780494 | B1 | 11/2002 |
| FR | 25 49 092 | | 5/1983 |
| FR | 2657090 | | 11/1995 |
| GB | 294237 | | 9/1929 |
| GB | 493935 | | 10/1938 |
| GB | 2343681 | | 7/2000 |
| JP | 5311133 | | 2/1978 |
| JP | 57 060098 | | 4/1982 |
| JP | 05287587 | A | 8/1982 |
| JP | 58 001093 | | 1/1983 |
| JP | 59 016994 | | 1/1984 |
| JP | 09503824 | | 4/1997 |
| JP | 3132133 | B2 * | 2/2001 |
| RU | 2049162 | | 11/1995 |
| RU | 2112087 | | 5/1998 |
| SU | 617493 | | 7/1978 |
| WO | WO 92/14868 | | 9/1992 |
| WO | WO 98/42892 | | 3/1998 |
| WO | WO 99/02759 | | 7/1998 |
| WO | WO 98/42895 | | 10/1998 |
| WO | WO 00/03069 | | 1/2000 |
| WO | WO 02/28838 | A2 | 4/2002 |
| WO | WO 03/029529 | A | 4/2003 |

OTHER PUBLICATIONS

U.S. Appl. No. 10/297,592, filed Oct. 25, 2004, Dolan, Co-pending case.

Zozulin, Alex J.; "A Chromate-Free Anodize Process for Magnesium Alloys: A Coating with Superior Characteristics", pp. 47-63.

Zozulin, et al.; "Anodized Coatings for magnesium Alloys", Metal Finishing, Mar. 1994, pp. 39-44.

IBM Technical Disclosure Bulletin, "Forming Protective Coatings on Magnesium Alloys", Dec. 1967, p. 862.

Barton, et al.; "The Effect of Electrolyte on the Anodized Finish of a magnesium Alloy"; Plating & Surface Finishing, pp. 138-141.

Jacobson, et al.; "American Electroplaters and Surface Finishers Society", pp. 541-549.

Surface and Coatings Technology 122, "Plazma Electrolysis for Surface Engineering", (1999), pp. 73-93.

Galvanotechnik, "Plasmachemische Oxidationsverfahren Teil 1: Historie und Verfahrensgrundlagen", (Apr. 2003), pp. 816-823.

Galvanotechnik, "Plasmachemische Oxidationsverfahren Teil 2: Apparative Voraussetzungen", Jun. 2003, pp. 1374-1382.

Galvanotechnik, Plasmachemische Oxidationsverfahren Teil 3: Neue Schicht-systeme, aussergewoehnliche Substratmaterialien und deren gegenwaetige und zukueftige Anwendungsfelder, (Jul. 2003), pp. 1634-1645.

Sworn Declaration of Dr. Peter Kurze dated Jul. 5, 2000, submitted in connection with PCT Publication WO96/28591 of Magnesiu Technology Limited.

JP 57131391 A (abstract).

* cited by examiner

PROCESS FOR ANODICALLY COATING AN ALUMINUM SUBSTRATE WITH CERAMIC OXIDES PRIOR TO POLYTETRAFLUOROETHYLENE OR SILICONE COATING

This application is a continuation-in-part of application Ser. No. 10/162,965, filed Jun. 5, 2002, now U.S. Pat. No. 6,916,414, which is a continuation-in-part of application Ser. No. 10/033,554, filed Oct. 19, 2001, now abandoned, which is a continuation-in-part of application Ser. No. 09/968,023, filed Oct. 2, 2001, now abandoned, each of which are incorporated herein by reference.

FIELD OF THE INVENTION

This invention relates to the anodization of aluminum and aluminum alloy workpieces to provide coatings comprising titanium and/or zirconium oxides, and the subsequent coating of the anodized workpiece with non-stick coatings comprising polytetrafluoroethylene (hereinafter referred to as "PTFE") or silicone. The invention is especially useful for forming longer life PTFE or silicone non-stick coatings on aluminum substrates.

BACKGROUND OF THE INVENTION

Aluminum and its alloys have found a variety of industrial applications. However, because of the reactivity of aluminum and its alloys, and their tendency toward corrosion and environmental degradation, it is necessary to provide the exposed surfaces of these metals with an adequate corrosion-resistant and protective coating. Further, such coatings should resist abrasion so that the coatings remain intact during use, where the metal article may be subjected to repeated contact with other surfaces, particulate matter and the like. Where the appearance of articles fabricated is considered important, the protective coating applied thereto should additionally be uniform and decorative.

In order to provide an effective and permanent protective coating on aluminum and its alloys, such metals have been anodized in a variety of electrolyte solutions, such as sulfuric acid, oxalic acid and chromic acid, which produce an alumina coating on the substrate. While anodization of aluminum and its alloys is capable of forming a more effective coating than painting or enameling, the resulting coated metals have still not been entirely satisfactory for their intended uses. The coatings frequently lack one or more of the desired degree of flexibility, hardness, smoothness, durability, adherence, heat resistance, resistance to acid and alkali attack, corrosion resistance, and/or imperviousness required to meet the most demanding needs of industry.

Heat resistance is a very desirable feature of a protective coating for aluminum and its alloys. In the cookware industry, for instance, aluminum is a material of choice due to its light weight and rapid heat conduction properties. However, bare aluminum is subject to corrosion and discoloration, particularly when exposed to ordinary food acids such as lemon juice and vinegar, as well as alkali, such as dishwasher soap. PTFE or silicone containing paints are a common heat resistant coating for aluminum, which provide resistance to corrosion, discoloration and give a "non-stick" cooking surface. However, PTFE containing paints have the drawback of insufficient adherence to the substrate to resist peeling when subjected to abrasion. To improve adherence of PTFE coatings, manufacturers generally must provide three coats of paint on the aluminum substrate: a primer, a midlayer and finally a topcoat containing PTFE. This three-step process is costly and does not solve the problem of insufficient abrasion resistance and the problem of subsequent corrosion of the underlying aluminum when the protective paint, in particular the PTFE coating wears off. Likewise, the non-stick silicone coatings eventually wear away and the underlying aluminum is exposed to acid, alkali and corrosive attack.

To improve toughness and abrasion resistance, it is known in the cookware industry to anodize aluminum to deposit a coating of aluminum oxide, using a strongly acidic bath (pH<1), and to thereafter apply a non-stick seal coating containing PTFE. A drawback of this method is the nature of the anodized coating produced. The aluminum oxide coating is not as impervious to acid and alkali as oxides of titanium and/or zirconium. Articles coated using this known process lose their PTFE coatings with repeated exposure to typical dishwasher cycles of hot water and alkaline cleaning agents.

So called, hard anodizing aluminum results in a harder coating of aluminum oxide, deposited by anodic coating at pH<1 and temperatures of less than 3° C., which generates an alpha phase alumina crystalline structure that still lacks sufficient resistance to corrosion and alkali attack.

In another known attempt to provide a corrosion-, heat- and abrasion-resistant coating to support adherence of PTFE to aluminum, an aluminum alloy was thermally sprayed with titanium dioxide to generate a film that is physically adhered to the underlying aluminum. This film had some adherence to the aluminum article, but showed voids in the coating that are undesirable.

Thus, there is still considerable need to develop alternative anodization processes for aluminum and its alloys which do not have any of the aforementioned shortcomings and yet still furnish adherent, corrosion-, heat- and abrasion-resistant protective coatings of high quality and pleasing appearance.

SUMMARY OF THE INVENTION

Applicant has developed a process whereby articles of aluminum or aluminum alloy may be rapidly anodized to form protective coatings that are resistant to corrosion and abrasion using anodizing solutions containing complex fluorides and/or complex oxyfluorides. The anodizing solution is aqueous and comprises one or more components selected from water-soluble and water-dispersible complex fluorides and oxyfluorides of elements selected from the group consisting of Ti, Zr, Hf, Sn, Al, Ge and B. The use of the term "solution" herein is not meant to imply that every component present is necessarily fully dissolved and/or dispersed. Some anodizing solutions of the invention comprise a precipitate or develop a small amount of sludge in the bath during use, which does not adversely affect performance. In especially preferred embodiments of the invention, the anodizing solution comprises one or more components selected from the group consisting of the following:

a) water-soluble and/or water-dispersible phosphorus oxysalts, wherein the phosphorus concentration in the anodizing solution is at least 0.01 M;
b) water-soluble and/or water-dispersible complex fluorides of elements selected from the group consisting of Ti, Zr, Hf, Sn, Al, Ge and B;
c) water-soluble and/or water-dispersible zirconium oxysalts;
d) water-soluble and/or water-dispersible vanadium oxysalts;
e) water-soluble and/or water-dispersible titanium oxysalts;
f) water-soluble and/or water-dispersible alkali metal fluorides;
g) water-soluble and/or water-dispersible niobium salts;
h) water-soluble and/or water-dispersible molybdenum salts;

i) water-soluble and/or water-dispersible manganese salts;

j) water-soluble and/or water-dispersible tungsten salts; and k) water-soluble and/or water-dispersible alkali metal hydroxides.

In one embodiment of the invention, niobium, molybdenum, manganese, and/or tungsten salts are co-deposited in a ceramic oxide film of zirconium and/or titanium.

The method of the invention comprises providing a cathode in contact with the anodizing solution, placing the article as an anode in the anodizing solution, and passing a current through the anodizing solution at a voltage and for a time effective to form the protective coating on the surface of the article. Pulsed direct current or alternating current is generally preferred. Non-pulsed direct current may also be used. When using pulsed current, the average voltage is preferably not more than 250 volts, more preferably, not more than 200 volts, or, most preferably, not more than 175 volts, depending on the composition of the anodizing solution selected. The peak voltage, when pulsed current is being used, is preferably not more than 600, most preferably 500 volts. In one embodiment, the peak voltage for pulsed current is not more than, in increasing order of preference 600, 575, 550, 525, 500 volts and independently not less than 300, 310, 320, 330, 340, 350, 360, 370, 380, 390, 400 volts. When alternating current is being used, the voltage may range from about 200 to about 600 volts. In another alternating current embodiment, the voltage is, in increasing order of preference 600, 575, 550, 525, 500 volts and independently not less than 300, 310, 320, 330, 340, 350, 360, 370, 380, 390, 400 volts. In the presence of phosphorus containing components, non-pulsed direct current, also known as straight direct current, may be used at voltages from about 200 to about 600 volts. The non-pulsed direct current desirably has a voltage of, in increasing order of preference 600, 575, 550, 525, 500 volts and independently not less than 300, 310, 320, 330, 340, 350, 360, 370, 380, 390, 400 volts.

It is an object of the invention to provide a method of forming a protective coating on a surface of a metal article comprising aluminum or aluminum alloy, the method comprising: providing an anodizing solution comprised of water and one or more additional components selected from the group consisting of water-soluble complex fluorides, water-soluble complex oxyfluorides, water-dispersible complex fluorides, and water-dispersible complex oxyfluorides of elements selected from the group consisting of Ti, Zr, Hf, Sn, Al, Ge and B and mixtures thereof; providing a cathode in contact with the anodizing solution; placing a metal article comprising aluminum or aluminum alloy as an anode in the anodizing solution; passing a current between the anode and cathode through the anodizing solution for a time effective to form a first protective coating on the surface of the metal article; removing the metal article having a first protective coating from the anodizing solution and drying the article; and applying one or more layers of paint to the metal article having a first protective coating, at least one of the layers comprising PTFE or silicone, to form a second protective coating.

It is a further object of the invention to provide a method wherein the first protective coating comprises titanium dioxide and/or zirconium oxide. It is a yet further object of the invention to provide a method wherein the first protective coating is comprised of titanium dioxide and the current is direct current.

It is a further object of the invention to provide a method wherein the anodizing solution is maintained at a temperature of from 0° C. to 90° C. It is also a further object of the invention to provide a method wherein the current is pulsed direct current having an average voltage of not more than 200 volts. It is a further object of the invention to provide a method wherein the metal article is aluminum and the current is direct current or alternating current. It is a further object of the invention to provide a method wherein the current is pulsed direct current.

It is a further object of the invention to provide a method wherein the protective coating is formed at a rate of at least 1 micron thickness per minute.

It is a further object of the invention to provide a method wherein the second protective coating comprises a non-stick topcoat comprising PTFE or silicone and at least one additional paint layer between the topcoat and the first protective coating.

It is a further object of the invention to provide a method wherein the anodizing solution is prepared using a complex fluoride selected from the group consisting of $H_2TiF_6$, $H_2ZrF_6$, $H_2HfF_6$, $H_2SnF_6$, $H_2GeF_6$, $H_3AlF_6$, $HBF_4$ and salts and mixtures thereof and optionally comprises HF or a salt thereof.

It is a further object of the invention to provide a method wherein the anodizing solution is additionally comprised of a phosphorus containing acid and/or salt, and/or a chelating agent. Preferably, the phosphorus containing acid and/or salt comprises one or more of a phosphoric acid, a phosphoric acid salt, a phosphorous acid and a phosphorous acid salt. It is a further object of the invention to provide a method wherein pH of the anodizing solution is adjusted using ammonia, an amine, an alkali metal hydroxide or a mixture thereof.

It is an object of the invention to provide a method of forming a protective coating on a surface of a metallic article comprised predominantly of aluminum, the method comprising: providing an anodizing solution comprised of water, a phosphorus containing acid and/or salt, and one or more additional components selected from the group consisting of water-soluble and water-dispersible complex fluorides and mixtures thereof, the fluorides comprising elements selected from the group consisting of Ti, Zr, and combinations thereof; providing a cathode in contact with the anodizing solution; placing a metallic article comprised predominantly of aluminum as an anode in the anodizing solution; passing a direct current or an alternating current between the anode and the cathode for a time effective to form a first protective coating on the surface of the metal article; removing the metal article having a first protective coating from the anodizing solution and drying the article; and applying one or more layers of paint to the metal article having a first protective coating, at least one of the layers comprising PTFE or silicone, to form a second protective coating.

It is a further object of the invention to provide a method wherein the anodizing solution is prepared using a complex fluoride comprising an anion comprising at least 4 fluorine atoms and at least one atom selected from the group consisting of Ti, Zr, and combinations thereof.

It is a further object of the invention to provide a method wherein the anodizing solution is prepared using a complex fluoride selected from the group consisting of $H_2TiF_6$, $H_2ZrF_6$, salts of $H_2TiF_6$, salts of $H_2ZrF_6$, and mixtures thereof.

It is a further object of the invention to provide a method wherein the complex fluoride is introduced into the anodizing solution at a concentration of at least 0.05M.

It is a further object of the invention to provide a method wherein the direct current has an average voltage of not more than 250 volts.

It is a further object of the invention to provide a method wherein the anodizing solution is additionally comprised of a chelating agent.

It is a further object of the invention to provide a method wherein the anodizing solution is comprised of at least one complex oxyfluoride prepared by combining at least one complex fluoride of at least one element selected from the group consisting of Ti, Zr, and at least one compound which is an oxide, hydroxide, carbonate or alkoxide of at least one element selected from the group consisting of Ti, Zr, Hf, Sn, B, Al and Ge.

It is a further object of the invention to provide a method wherein the anodizing solution has a pH of from about 2 to about 6.

It is an object of the invention to provide a method of forming a protective coating on an article having a metallic surface comprised of aluminum or aluminum alloy, the method comprising: providing an anodizing solution, the anodizing solution having been prepared by dissolving a water-soluble complex fluoride and/or oxyfluoride of an element selected from the group consisting of Ti, Zr, Hf, Sn, Ge, B and combinations thereof and an inorganic acid or salt thereof that contains phosphorus in water; providing a cathode in contact with the anodizing solution; placing an article comprising at least one metallic surface comprised of aluminum or aluminum alloy as an anode in the anodizing solution; passing a direct current or an alternating current between the anode and the cathode for a time effective to form a first protective coating on the at least one metallic surface; removing the article comprising at least one metallic surface having a first protective coating from the anodizing solution and drying the article; and applying one or more layers of paint to the first protective coating, at least one of the layers comprising PTFE or silicone, to form a second protective coating.

It is a further object of the invention to provide a method wherein pH of the anodizing solution is adjusted using ammonia, an amine, an alkali metal hydroxide or a mixture thereof.

It is a further object of the invention to provide a method wherein the current is pulsed direct current having an average voltage of not more than 150 volts.

It is a further object of the invention to provide a method wherein at least one compound which is an oxide, hydroxide, carbonate or alkoxide of at least one element selected from the group consisting of Ti, Zr, Hf, Sn, B, Al and Ge is additionally used to prepare the anodizing solution.

It is an object of the invention to provide a method of forming a protective coating on a surface of an article comprised of aluminum, the method comprising: providing an anodizing solution, the anodizing solution having been prepared by combining one or more water-soluble complex fluorides of titanium and/or zirconium or salts thereof, a phosphorus containing oxy acid and/or salt and optionally, an oxide, hydroxide, carbonate or alkoxide of zirconium; providing a cathode in contact with the anodizing solution; placing an article comprised of aluminum as an anode in the anodizing solution; and passing a direct current or an alternating current between the anode and the cathode for a time effective to form the protective coating on a surface of the article; removing the article having a first protective coating from the anodizing solution and drying the article; and applying one or more layers of paint to the article having a first protective coating, at least one of the layers comprising PTFE or silicone, to form a second protective coating.

It is a further object of the invention to provide a method wherein one or more of $H_2TiF_6$, salts of $H_2TiF_6$, $H_2ZrF_6$, and salts of $H_2ZrF_6$ is used to prepare the anodizing solution. It is a further object of the invention to provide a method wherein zirconium basic carbonate is also used to prepare the anodizing solution. It is a further object of the invention to provide a method wherein the one or more water-soluble complex fluorides is a complex fluoride of titanium or zirconium and the current is direct current, pulsed or non-pulsed.

DETAILED DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the scope of the invention. Practice within the numerical limits stated is generally preferred, however. Also, throughout the description, unless expressly stated to the contrary: percent, "parts of", and ratio values are by weight or mass; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) between one or more newly added constituents and one or more constituents already present in the composition when the other constituents are added; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise, such counterions may be freely selected, except for avoiding counterions that act adversely to an object of the invention; the term "paint" and its grammatical variations includes any more specialized types of protective exterior coatings that are also known as, for example, lacquer, electropaint, shellac, porcelain enamel, top coat, mid coat, base coat, color coat, and the like; the word "mole" means "gram mole", and the word itself and all of its grammatical variations may be used for any chemical species defined by all of the types and numbers of atoms present in it, irrespective of whether the species is ionic, neutral, unstable, hypothetical or in fact a stable neutral substance with well defined molecules; and the terms "solution", "soluble", "homogeneous", and the like are to be understood as including not only true equilibrium solutions or homogeneity but also dispersions.

There is no specific limitation on the aluminum or aluminum alloy article to be subjected to anodization in accordance with the present invention. It is desirable that at least a portion of the article is fabricated from a metal that contains not less than 50% by weight, more preferably not less than 70% by weight aluminum. Preferably, the article is fabricated from a metal that contains not less than, in increasing order of preference, 30, 40, 50, 60, 70, 80, 90, 100% by weight aluminum.

In carrying out the anodization of a workpiece, an anodizing solution is employed which is preferably maintained at a temperature between about 0° C. and about 90° C. It is desirable that the temperature be at least about, in increasing order of preference 5, 10, 15, 20, 25, 30, 40, 50° C. and not more than 90, 88, 86, 84, 82, 80, 75, 70, 65° C.

The anodization process comprises immersing at least a portion of the workpiece in the anodizing solution, which is preferably contained within a bath, tank or other such container. The article (workpiece) functions as the anode. A second metal article that is cathodic relative to the workpiece is also placed in the anodizing solution. Alternatively, the anodizing solution is placed in a container which is itself cathodic relative to the workpiece (anode). When using pulsed current, an average voltage potential not in excess of in increasing order of preference 250 volts, 200 volts, 175 volts, 150 volts, 125 volts is then applied across the electrodes until a coating of the desired thickness is formed on the surface of the aluminum article in contact with the anodizing solution. When certain anodizing solution compositions are used, good results may be obtained even at average voltages not in excess of 100 volts. It has been observed that the formation of a corrosion- and abrasion-resistant protective coating is often associated with anodization conditions which are effective to cause a visible light-emitting discharge (sometimes referred to herein as a "plasma", although the use of this term is not meant to imply that a true plasma exists) to be generated (either on a continuous or intermittent or periodic basis) on the surface of the aluminum article.

In one embodiment, direct current (DC) is used at 10-400 Amps/square foot and 200 to 600 volts. In another embodiment, the current is pulsed or pulsing current. Non-pulsed direct current is desirably used in the range of 200-600 volts; preferably the voltage is at least, in increasing order of preference 200, 250, 300, 350, 400 and at least for the sake of economy, not more than in increasing order of preference 700, 650, 600, 550. Direct current is preferably used, although alternating current may also be utilized (under some conditions, however, the rate of coating formation may be lower using AC). The frequency of the current may range from 10 to 10,000 Hertz; higher frequencies may be used. In embodiments where AC power is used, 300 to 600 volts is the preferred voltage level.

In a preferred embodiment, the pulsed signal may have an "off" time between each consecutive voltage pulse preferably lasting between about 10% as long as the voltage pulse and about 1000% as long as the voltage pulse. During the "off" period, the voltage need not be dropped to zero (i.e., the voltage may be cycled between a relatively low baseline voltage and a relatively high ceiling voltage). The baseline voltage thus may be adjusted to a voltage that is from 0% to 99.9% of the peak applied ceiling voltage. Low baseline voltages (e.g., less than 30% of the peak ceiling voltage) tend to favor the generation of a periodic or intermittent visible light-emitting discharge, while higher baseline voltages (e.g., more than 60% of the peak ceiling voltage) tend to result in continuous plasma anodization (relative to the human eye frame refresh rate of 0.1-0.2 seconds). The current can be pulsed with either electronic or mechanical switches activated by a frequency generator. The average amperage per square foot is at least in increasing order of preference 10, 20, 30, 40, 50, 60, 70, 80, 90, 100, 105, 110, 115, and not more than at least for economic considerations in increasing order of preference 300, 275, 250, 225, 200, 180, 170, 160, 150, 140, 130, 125. More complex waveforms may also be employed, such as, for example, a DC signal having an AC component. Alternating current may also be used, with voltages desirably between about 200 and about 600 volts. The higher the concentration of the electrolyte in the anodizing solution, the lower the voltage can be while still depositing satisfactory coatings.

A number of different types of anodizing solutions may be successfully used in the process of this invention, as will be described in more detail hereinafter. However, it is believed that a wide variety of water-soluble or water-dispersible anionic species containing metal, metalloid, and/or non-metal elements are suitable for use as components of the anodizing solution. Suitable elements include, for example, phosphorus, titanium, zirconium, hafnium, tin, germanium, boron, vanadium, fluoride, zinc, niobium, molybdenum, manganese, tungsten and the like (including combinations of such elements). In a preferred embodiment of the invention, the components of the anodizing solution are titanium and/or zirconium.

Without wishing to be bound by theory, it is thought that the anodization of aluminum and aluminum alloy articles in the presence of complex fluoride or oxyfluoride species to be described subsequently in more detail leads to the formation of surface films comprised of metal/metalloid oxide ceramics (including partially hydrolyzed glasses containing O, OH and/or F ligands) or metal/non-metal compounds wherein the metal comprising the surface film includes metals from the complex fluoride or oxyfluoride species and some metals from the article. The plasma or sparking which often occurs during anodization in accordance with the present invention is believed to destabilize the anionic species, causing certain ligands or substituents on such species to be hydrolyzed or displaced by O and/or OH or metal-organic bonds to be replaced by metal-O or metal-OH bonds. Such hydrolysis and displacement reactions render the species less water-soluble or water-dispersible, thereby driving the formation of the surface coating.

A pH adjuster may be present in the anodizing solution; suitable pH adjusters include, by way of nonlimiting example, ammonia, amine or other base. The amount of pH adjuster is limited to the amount required to achieve a pH of 2-11, preferably 2-8 and most preferably 3-6; and is dependent upon the type of electrolyte used in the anodizing bath. In a preferred embodiment, the amount of pH adjuster is less than 1% w/v.

In certain embodiments of the invention, the anodizing solution is essentially (more preferably, entirely) free of chromium, permanganate, borate, sulfate, free fluoride and/or free chloride.

The anodizing solution used preferably comprises water and at least one complex fluoride or oxyfluoride of an element selected from the group consisting of Ti, Zr, Hf, Sn, Al, Ge and B (preferably, Ti and/or Zr). The complex fluoride or oxyfluoride should be water-soluble or water-dispersible and preferably comprises an anion comprising at least 1 fluorine atom and at least one atom of an element selected from the group consisting of Ti, Zr, Hf, Sn, Al, Ge or B. The complex fluorides and oxyfluorides (sometimes referred to by workers in the field as "fluorometallates") preferably are substances with molecules having the following general empirical formula (I):

$$H_pT_qF_rO_s \quad (I)$$

wherein: each of p, q, r, and s represents a non-negative integer; T represents a chemical atomic symbol selected from the group consisting of Ti, Zr, Hf, Sn, Al, Ge, and B; r is at least 1; q is at least 1; and, unless T represents B, (r+s) is at least 6. One or more of the H atoms may be replaced by suitable cations such as ammonium, metal, alkaline earth metal or alkali metal cations (e.g., the complex fluoride may be in the form of a salt, provided such salt is water-soluble or water-dispersible).

Illustrative examples of suitable complex fluorides include, but are not limited to, H2TiF6, H2ZrF6, H2HfF6, H2GeF6, H2SnF6, H3AlF6, and HBF4 and salts (fully as well as partially neutralized) and mixtures thereof. Examples of suitable complex fluoride salts include SrZrF6, MgZrF6, Na2ZrF6, Li2ZrF6, SrTiF6, MgTiF6, Na2TiF6 and Li2TiF6.

The total concentration of complex fluoride and complex oxyfluoride in the anodizing solution preferably is at least about 0.005 M. Generally, there is no preferred upper concentration limit, except of course for any solubility constraints. It is desirable that the total concentration of complex fluoride and complex oxyfluoride in the anodizing solution be at least 0.005, 0.010, 0.020, 0.030, 0.040, 0.050, 0.060, 0.070, 0.080, 0.090, 0.10, 0.20, 0.30, 0.40, 0.50, 0.60 M, and if only for the sake of economy be not more than, in increasing order of preference 2.0, 1.5, 1.0, 0.80 M.

To improve the solubility of the complex fluoride or oxyfluoride, especially at higher pH, it may be desirable to include an inorganic acid (or salt thereof) that contains fluorine but does not contain any of the elements Ti, Zr, Hf, Sn, Al, Ge or B in the electrolyte composition. Hydrofluoric acid or a salt of hydrofluoric acid such as ammonium bifluoride is preferably used as the inorganic acid. The inorganic acid is believed to prevent or hinder premature polymerization or condensation of the complex fluoride or oxyfluoride, which otherwise (particularly in the case of complex fluorides having an atomic ratio of fluorine to "T" of 6) may be susceptible to slow spontaneous decomposition to form a water-insoluble oxide. Certain commercial sources of hexafluorotitanic acid and hexafluorozirconic acid are supplied with an inorganic acid or salt thereof, but it may be desirable in certain embodiments of the invention to add still more inorganic acid or inorganic salt.

A chelating agent, especially a chelating agent containing two or more carboxylic acid groups per molecule such as nitrilotriacetic acid, ethylene diamine tetraacetic acid, N-hydroxyethyl-ethylenediamine triacetic acid, or diethylene-triamine pentaacetic acid or salts thereof, may also be included in the anodizing solution. Other Group IV compounds may be used, such as, by way of non-limiting example, Ti and/or Zr oxalates and/or acetates, as well as other stabilizing ligands, such as acetylacetonate, known in the art that do not interfere with the anodic deposition of the anodizing solution and normal bath lifespan. In particular, it is necessary to avoid organic materials that either decompose or undesirably polymerize in the energized anodizing solution.

Suitable complex oxyfluorides may be prepared by combining at least one complex fluoride with at least one compound which is an oxide, hydroxide, carbonate, carboxylate or alkoxide of at least one element selected from the group consisting of Ti, Zr, Hf, Sn, B, Al, or Ge. Examples of suitable compounds of this type that may be used to prepare the anodizing solutions of the present invention include, without limitation, zirconium basic carbonate, zirconium acetate and zirconium hydroxide. The preparation of complex oxyfluorides suitable for use in the present invention is described in U.S. Pat. No. 5,281,282, incorporated herein by reference in its entirety. The concentration of this compound used to make up the anodizing solution is preferably at least, in increasing preference in the order given, 0.0001, 0.001 or 0.005 moles/kg (calculated based on the moles of the element(s) Ti, Zr, Hf, Sn, B, Al and/or Ge present in the compound used). Independently, the ratio of the concentration of moles/kg of complex fluoride to the concentration in moles/kg of the oxide, hydroxide, carbonate or alkoxide compound preferably is at least, with increasing preference in the order given, 0.05:1, 0.1:1, or 1:1. In general, it will be preferred to maintain the pH of the anodizing solution in this embodiment of the invention in the range of from about 2 to about 11, more preferably 2-8, and in one embodiment a pH of 2-6.5 is desirable. A base such as ammonia, amine or alkali metal hydroxide may be used, for example, to adjust the pH of the anodizing solution to the desired value.

Rapid coating formation is generally observed at average voltages of 150 volts or less (preferably 100 or less), using pulsed DC. It is desirable that the average voltage be of sufficient magnitude to generate coatings of the invention at a rate of at least about 1 micron thickness per minute, preferably at least 3-8 microns in 3 minutes. If only for the sake of economy, it is desirable that the average voltage be less than, in increasing order of preference, 150, 140, 130, 125, 120, 115, 110, 100, 90 volts. The time required to deposit a coating of a selected thickness is inversely proportional to the concentration of the anodizing bath and the amount of current Amps/square foot used. By way of non-limiting example, parts may be coated with an 8 micron thick metal oxide layer in as little as 10-15 seconds at concentrations cited in the Examples by increasing the Amps/square foot to 300-2000 amps/square foot. The determination of correct concentrations and current amounts for optimum part coating in a given period of time can be made by one of skill in the art based on the teachings herein with minimal experimentation.

Coatings of the invention are typically fine-grained and desirably are at least 1 micron thick, preferred embodiments have coating thicknesses from 1-20 microns. Thinner or thicker coatings may be applied, although thinner coatings may not provide the desired coverage of the article. Without being bound by a single theory, it is believed that, particularly for insulating oxide films, as the coating thickness increases the film deposition rate is eventually reduced to a rate that approaches zero asymptotically. Add-on mass of coatings of the invention ranges from approximately 5-200 g/m$^2$ or more and is a function of the coating thickness and the composition of the coating. It is desirable that the add-on mass of coatings be at least, in increasing order of preference, 5, 10, 11, 12, 14, 16, 18, 20, 25, 30, 35, 40, 45, 50 g/m$^2$.

An anodizing solution for use in forming a white protective coating on an aluminum or aluminum alloy substrate may be prepared using the following components:

| | |
|---|---|
| Zirconium Basic Carbonate | 0.01 to 1 wt. % |
| $H_2ZrF_6$ | 0.1 to 10 wt. % |
| Water | Balance to 100% |

pH adjusted to the range of 2 to 5 using ammonia, amine or other base.

In a preferred embodiment utilizing zirconium basic carbonate and $H_2ZrF_6$, it is desirable that the anodizing solution comprise zirconium basic carbonate in an amount of at least, in increasing order of preference 0.05, 0.10, 0.15, 0.20, 0.25, 0.30, 0.35, 0.40, 0.45, 0.50, 0.55, 0.60 wt. % and not more than, in increasing order of preference 1.0, 0.97, 0.95, 0.92, 0.90, 0.87, 0.85, 0.82, 0.80, 0.77 wt. %. In this embodiment, it is desirable that the anodizing solution comprises $H_2ZrF_6$ in an amount of at least, in increasing order of preference 0.2, 0.4, 0.6, 0.8.1.0, 1.2, 1.3, 1.4, 1.5, 2.0, 2.5, 3.0, 3.5, wt. % and not more than, in increasing order of preference 10, 9.75, 9.5, 9.25, 9.0, 8.75, 8.5, 8.25, 8.0, 7.75 4.0, 4.5, 5.0, 5.5, 6.0 wt. %.

In a particularly preferred embodiment the amount of zirconium basic carbonate ranges from about 0.75 to 0.25 wt. %, the $H_2ZrF_6$ ranges from 6.0 to 9.5 wt %; a base such as ammonia is used to adjust the pH to ranges from 3 to 5.

It is believed that the zirconium basic carbonate and the hexafluorozirconic acid combine to at least some extent to form one or more complex oxyfluoride species. The resulting anodizing solution permits rapid anodization of aluminum-containing articles using pulsed direct current having an average voltage of not more than 175 volts. In this particular embodiment of the invention, better coatings are generally obtained when the anodizing solution is maintained at a relatively high temperature during anodization (e.g., 40 degrees C. to 80 degrees C.). Alternatively, alternating current preferably having a voltage of from 300 to 600 volts may be used. The solution has the further advantage of forming protective coatings that are white in color, thereby eliminating the need to paint the anodized surface if a white decorative finish is desired. The anodized coatings produced in accordance with this embodiment of the invention typically have L values of at least 80, high hiding power at coating thicknesses of 4 to 8 microns, and excellent acid, alkali and corrosion resistance. To the best of the inventor's knowledge, no anodization technologies being commercially practiced today are capable of producing coatings having this desirable combination of properties.

In another particularly preferred embodiment of the invention, the anodizing solution used comprises water, a water-soluble or water-dispersible phosphorus containing acid or salt, such as a phosphorus oxyacid or salt, preferably an acid or salt containing phosphate anion; and at least one of $H_2TiF_6$ and $H_2ZrF_6$. It is desirable that the pH of the anodizing solution is neutral to acid, 6.5 to 1, more preferably, 6 to 2, most preferably 5-3.

It was surprisingly found that the combination of a phosphorus containing acid and/or salt and the complex fluoride in the anodizing solution produced a different type of anodically deposited coating. The oxide coatings deposited comprised predominantly oxides of anions present in the anodizing solution prior to any dissolution of the anode. That is, this process results in coatings that result predominantly from deposition of substances that are not drawn from the body of the anode, resulting in less change to the substrate of the article being anodized.

In this embodiment, it is desirable that the anodizing solution comprise the at least one complex fluoride, e.g. $H_2TiF_6$ and/or $H_2ZrF_6$ in an amount of at least, in increasing order of preference 0.2, 0.4, 0.6, 0.8, 1.0, 1.2, 1.3, 1.4, 1.5, 2.0, 2.5, 3.0, 3.5 wt. % and not more than, in increasing order of preference 10, 9.5, 9.0, 8.5, 8.0, 7.5, 7.0, 6.5, 6.0, 5.5, 5.0, 4.5, 4.0 wt. %. The at least one complex fluoride may be supplied from any suitable source such as, for example, various aqueous solutions known in the art. For $H_2TiF_6$ commercially available solutions typically range in concentration from 50-60 wt %; while for $H_2ZrF_6$ such solutions range in concentration between 20-50%.

The phosphorus oxysalt may be supplied from any suitable source such as, for example, ortho-phosphoric acid, pyrophosphoric acid, tri-phosphoric acid, meta-phosphoric acid, polyphosphoric acid and other combined forms of phosphoric acid, as well as phosphorous acids, and hypo-phosphorous acids, and may be present in the anodizing solution in partially or fully neutralized form (e.g., as a salt, wherein the counter ion(s) are alkali metal cations, ammonium or other such species that render the phosphorus oxysalt water-soluble). Organophosphates such as phosphonates and the like may also be used (for example, the various phosphonates available from Rhodia Inc. and Solutia Inc.) provided that the organic component does not interfere with the anodic deposition.

Particularly preferred is the use of a phosphorus oxysalt in acid form. The phosphorus concentration in the anodizing solution is at least 0.01 M. It is preferred that the concentration of phosphorus in the anodizing solution be at least, in increasing order of preference, 0.01M, 0.015, 0.02, 0.03, 0.04, 0.05, 0.07, 0.09, 0.10, 0.12, 0.14, 0.16. In embodiments where the pH of the anodizing solution is acidic (pH<7), the phosphorus concentration can be 0.2 M, 0.3 M or more and preferably, at least for economy is not more than 1.0, 0.9, 0.8, 0.7, 0.6 M. In embodiments where the pH is neutral to basic, the concentration of phosphorus in the anodizing solution is not more than, in increasing order of preference 0.40, 0.30, 0.25, 0.20 M.

A preferred anodizing solution for use in forming a protective ceramic coating according to this embodiment on an aluminum or aluminum alloy substrate may be prepared using the following components:

| | |
|---|---|
| $H_2TiF_6$ | 0.05 to 10 wt. % |
| $H_3PO_4$ | 0.1 to 0.6 wt. % |
| Water | Balance to 100% |

The pH is adjusted to the range of 2 to 6 using ammonia, amine or other base.

With the aforedescribed anodizing solutions, the generation of a sustained "plasma" (visible light emitting discharge) during anodization is generally attained using pulsed DC having an average voltage of no more than 150 volts. In preferred operation, the average voltage does not exceed 100 volts.

The anodized coatings produced in accordance with the invention typically range in color from blue-grey and light grey to charcoal grey depending upon the coating thickness and relative amounts of Ti and Zr oxides in the coatings. The coatings exhibit high hiding power at coating thicknesses of 2-10 microns, and excellent acid, alkali and corrosion resistance. A test panel of a 400 series aluminum alloy anodically coated according to a process of the invention had an 8-micron thick layer of adherent ceramic predominantly comprising titanium dioxide. This coated test panel was scratched down to bare metal prior to salt fog testing. Despite being subjected to 1000 hours of salt fog testing according to ASTM B-117-03, there was no corrosion extending from the scribed line.

A commercially available bare aluminum wheel was cut into pieces and the test specimen was anodically coated according to a process of the invention with a 10-micron thick layer of ceramic predominantly comprising titanium dioxide. Without being bound to a single theory, the darker grey coating is attributed to the greater thickness of the coating. The coating completely covered the surfaces of the aluminum wheel including the design edges. The coated aluminum wheel portion had a line scratched into the coating down to bare metal prior to salt fog testing. Despite being subjected to 1000 hours of salt fog according to ASTM B-117-03, there is no corrosion extending from the scribed line and no corrosion at the design edges. References to "design edges" will be understood to include the cut edges as well as shoulders or indentations in the article which have or create external corners at the intersection of lines generated by the intersection of two planes. The excellent protection of the design edges is an improvement over conversion coatings, including chrome containing conversion coatings, which show corrosion at the design edges after similar testing.

In another aspect of the invention, Applicant surprisingly discovered that titanium containing substrates and aluminum containing substrates can be coated simultaneously in the anodizing process of the invention. A titanium clamp was used to hold an aluminum test panel during anodization according to the invention and both substrates, the clamp and the panel, were coated simultaneously according to the process of the invention. Although the substrates do not have the same composition, the coating on the surface appeared uniform and monochromatic. The substrates were anodically coated according to a process of the invention with a 7-micron thick layer of ceramic predominantly comprising titanium dioxide. The coating was a light grey in color, and provided good hiding power.

Before being subjected to anodic treatment in accordance with the invention, the aluminiferous metal article preferably is subjected to a cleaning and/or degreasing step. For example, the article may be chemically degreased by exposure to an alkaline cleaner such as, for example, a diluted solution of PARCO Cleaner 305 (a product of the Henkel Surface Technologies division of Henkel Corporation, Madison Heights, Mich.). After cleaning, the article preferably is rinsed with water. Cleaning may then, if desired, be followed by etching with an acidic deoxidixer/desmutter such as SC592, commercially available from Henkel Corporation, or other deoxidizing solution, followed by additional rinsing prior to anodization. Such pre-anodization treatments are well known in the art.

After anodization, the protective ceramic coatings produced on the surface of the workpiece are subjected to a further treatment comprising PTFE or silicone paint applied to the anodized surface, typically at a film build (thickness) of from about 3 to about 30 microns to form a non-stick layer. Suitable PTFE topcoats are known in the industry and typically comprise PTFE particles dispersed with surfactant, solvent and other adjuvants in water. Prior art PTFE-coated aluminiferous articles, require a primer and midcoat to be applied prior to a topcoat containing PTFE. Primers, midcoats and PTFE-containing topcoats, as well as silicone-containing paints, are known in the art and providing such non-stick coatings that are suitable for use in the invention is within the knowledge of those skilled in the art.

Articles having the first protective coating of the invention may be coated with PTFE coating systems known in the art, but do not require a three-step coating process to adhere PTFE. In embodiments having a zirconium oxide protective coating of the invention, Applicant surprisingly found that PTFE topcoat may be applied directly onto the zirconium oxide layer in the absence of any intermediate coating. In a preferred embodiment, the PTFE topcoat is applied to the zirconium oxide layer in the absence of a primer or midcoat or both. Similarly, embodiments having a titanium oxide protective coating of the invention, show good adhesion of the PTFE topcoat without application of a midcoat, thus eliminating one processing step and its attendant costs. In a preferred embodiment, the PTFE topcoat is applied to the titanium oxide layer having a primer thereon and in the absence of a midcoat, resulting in non-stick coating. Applicant also discovered that a silicone containing paint can be applied directly to zirconium and titanium coatings of the invention with good adherence resulting in non-stick coating.

The invention will now be further described with reference to a number of specific examples, which are to be regarded solely as illustrative and not as restricting the scope of the invention.

EXAMPLES

Example 1

An anodizing solution was prepared using the following components:

| | Parts per 1000 grams |
|---|---|
| Zirconium Basic Carbonate | 5.24 |
| Fluozirconic Acid (20% solution) | 80.24 |
| Deionized Water | 914.5 |

The pH was adjusted to 3.9 using ammonia. An aluminum-containing article was subjected to anodization for 120 seconds in the anodizing solution using pulsed direct current having a peak ceiling voltage of 450 volts (approximate average voltage=75 volts). The "on" time was 10 milliseconds, the "off" time was 30 milliseconds (with the "off" or baseline voltage being 0% of the peak ceiling voltage). A uniform white coating 6.3 microns in thickness was formed on the surface of the aluminum-containing article. A periodic to continuous plasma (rapid flashing just visible to the unaided human eye) was generated during anodization. The test panels of Example 1 were analyzed using energy dispersive spectroscopy and found to comprise a coating comprised predominantly of zirconium and oxygen.

Example 2

An aluminum alloy article was cleaned in a diluted solution of PARCO Cleaner 305, an alkaline cleaner, and an alkaline etch cleaner, Aluminum Etchant 34, both commercially available from Henkel Corporation. The aluminum alloy article was then desmutted in SC592, an iron based acidic deoxidizer commercially available from Henkel Corporation.

The aluminum alloy article was then coated, using the anodizing solution of Example 1, by being subjected to anodization for 3 minutes in the anodizing solution using pulsed direct current having a peak ceiling voltage of 500 volts (approximate average voltage=130 volts). The "on" time was 10 milliseconds, the "off" time was 30 milliseconds (with the "off" or baseline voltage being 0% of the peak ceiling voltage). Ceramic coatings of 3-6 microns in thickness were formed on the surface of the aluminum alloy article. The coatings had a uniform white appearance.

Example 3

A ceramic coated aluminum alloy article from Example 2 (said article hereinafter referred to as Example 3) was subjected to testing for adherence of PTFE and compared to a similar aluminum alloy article that had been subjected to the cleaning, etching and desmutting stages of Example 2 and then directly coated with PTFE as described below (Comparative Example 1).

Comparative Example 1 and Example 3 were rinsed in deionized water and dried. A standard PTFE-containing topcoat, commercially available from Dupont under the name 852-201, was spray applied as directed by the manufacturer. The PTFE coating on Comparative Example 1 and Example 3 were cured at 725° F. for 30 minutes and then immersed in cold water to cool to room temperature. The PTFE film thickness was 12-15 microns.

The films were crosshatched and subjected to adhesion tests wherein commercially available 898 tape was firmly adhered to each film and then pulled off at a 90° angle to the surface. Comparative Example 1 had 100% delamination of the PTFE coating in the cross-hatch area. No loss of adhesion was observed in the PTFE coating adhered to the ceramic-coated article from Example 3.

To assess hot/cold cycling stability, Example 3 was heated to 824° F. for two hours and immediately subjected to 10 cold-water dips. The film was again cross-hatched and no delamination of the PTFE coating was observed. The underlying ceramic coating showed no visual changes in appearance.

Example 4

An aluminum alloy substrate in the shape of a cookware pan was the test article for Example 4. The article was cleaned in a diluted solution of PARCO Cleaner 305, an alkaline cleaner, and an alkaline etch cleaner, such as Aluminum Etchant 34, both commercially available from Henkel Corporation. The aluminum alloy article was then desmutted in SCO592, an iron based acidic deoxidizer commercially available from Henkel Corporation.

The aluminum alloy article was then coated, using an anodizing solution prepared using the following components:

| | |
|---|---|
| $H_2TiF_6$ | 12.0 g/L |
| $H_3PO_4$ | 3.0 g/L |

The pH was adjusted to 2.1 using ammonia. The test article was subjected to anodization for 6 minutes in the anodizing solution using pulsed direct current having a peak ceiling voltage of 500 volts (approximate average voltage=140 volts). The "on" time was 10 milliseconds, the "off" time was 30 milliseconds (with the "off" or baseline voltage being 0% of the peak ceiling voltage). A uniform blue-grey coating 10 microns in thickness was formed on the surface of the test article. The test article was analyzed using energy dispersive spectroscopy and found to have a coating predominantly of titanium and oxygen, with trace amounts of phosphorus, estimated at less than 10 wt %. The titanium dioxide ceramic-coated test article of Example 4 was subjected to acid stability testing by heating lemon juice (citric acid) of pH 2 and boiling to dryness in the article. No change in the oxide layer was noted.

Example 5

An aluminum alloy test panel of 400 series aluminum alloy was coated according to the procedure of Example 4. A scribe line was scratched into the test panel down to bare metal prior to salt fog testing. Despite being subjected to 1000 hours of salt fog testing according to ASTM B-117-03, there was no corrosion extending from the scribed line.

Example 6

An aluminum alloy wheel was the test article for Example 6. The substrate was treated as in Example 4, except that the anodizing treatment was as follows:

The aluminum alloy article was coated, using an anodizing solution prepared using the following components:

| | |
|---|---|
| $H_2TiF_6$ (60%) | 20.0 g/L |
| $H_3PO_4$ | 4.0 g/L |

The pH was adjusted to 2.2 using aqueous ammonia. The article was subjected to anodization for 3 minutes in the anodizing solution using pulsed direct current having a peak ceiling voltage of 450 volts (approximate average voltage=130 volts) at 90° F. The "on" time was 10 milliseconds, the "off" time was 30 milliseconds (with the "off" or baseline voltage being 0% of the peak ceiling voltage). The average current density was 40 amps/ft2. A uniform coating, 8 microns in thickness, was formed on the surface of the aluminum-containing article. The article was analyzed using qualitative energy dispersive spectroscopy and found to have a coating predominantly of titanium, oxygen and a trace of phosphorus.

A line was scribed into the coated article down to bare metal and the article was subjected to the following testing: 1000 hours of salt fog per ASTM B-117-03. The article showed no signs of corrosion along the scribe line or along the design edges.

Example 7

An aluminum alloy test panel was treated as in Example 4. The test panel was submerged in the anodizing solution using a titanium alloy clamp. A uniform blue-grey coating, 7 microns in thickness, was formed on the surface of the predominantly aluminum test panel. A similar blue-grey coating, 7 microns, in thickness was formed on the surface of the predominantly titanium clamp. Both the test panel and the clamp were analyzed using qualitative energy dispersive spectroscopy and found to have a coating predominantly of titanium, oxygen and a trace of phosphorus.

Example 8

Aluminum alloy test panels of 6063 aluminum were treated according to the procedure of Example 4, except that the anodizing treatment was as follows:

The aluminum alloy articles were coated, using an anodizing solution containing phosphorous acid in place of phosphoric acid:

| | |
|---|---|
| $H_2TiF_6$ (60%) | 20.0 g/L |
| $H_3PO_3$ (70%) | 8.0 g/L |

The aluminum alloy articles were subjected to anodization for 2 minutes in the anodizing solution. Panel A was subjected to 300 to 500 volts applied voltage as direct current. Panel B was subjected to the same peak voltage but as pulsed direct current. A uniform grey coating 5 microns in thickness was formed on the surface of both Panel A and Panel B.

Example 9

The test article of Example 4, now having a coating of titanium dioxide ceramic, was the subject of Example 9. Example 9 was rinsed in deionized water and dried. The inside of the article was overcoated with Dupont Teflon® primer and topcoat paints, available from Dupont as 857-101 and 852-201, respectively, spray applied as directed by the manufacturer. The primer and topcoat on Example 9 were cured at 725° F. for 30 minutes and then immersed in cold water to cool to room temperature. The PTFE film thickness was 5-15 microns.

Comparative Example 2 was a commercially available aluminum pan having a non-stick seal over a hard-coat anodized coating of aluminum oxide on the inner and outer pan surfaces.

Table 1 shows the results of repeated exposure to typical dishwasher cycles of hot water and alkaline cleaning agents.

TABLE 1

| Example | Outside of Pan | Inside of Pan |
|---|---|---|
| Comparative Example 2 | Non-stick seal removed within 6 washes and hardcoat is attacked at surface - part develops white discoloration | Non-stick seal removed within 6 washes and hardcoat is attacked at surface - part is covered with white discoloration |
| Example 9 - Titanium Dioxide | Ceramic coating unaffected after 18 wash cycles | Teflon ® coating unaffected after 18 wash cycles |

Although the invention has been described with particular reference to specific examples, it is understood that modifications are contemplated. Variations and additional embodiments of the invention described herein will be apparent to those skilled in the art without departing from the scope of the invention as defined in the claims to follow. The scope of the invention is limited only by the breadth of the appended claims.

What is claimed is:

1. A method of forming a protective coating on a surface of a metal article comprising aluminum or aluminum alloy, said method comprising:

A) providing an anodizing solution comprised of water and one or more additional components selected from the group consisting of:
   a) water-soluble complex fluorides,
   b) water-soluble complex oxyfluorides,
   c) water-dispersible complex fluorides, and
   d) water-dispersible complex oxyfluorides of elements selected from the group consisting of Ti, Zr, Hf, Sn, Al, Ge and B and mixtures thereof;

B) providing a cathode in contact with said anodizing solution;

C) placing a metal article comprising aluminum or aluminum alloy as an anode in said anodizing solution;

D) passing a current between the anode and cathode through said anodizing solution for a time effective to form a first protective coating on the surface of the metal article;

E) removing the metal article having a first protective coating from the anodizing solution and drying said article; and F) applying one or more layers of paint to the metal article having a first protective coating, at least one of said layers comprising PTFE or silicone, to form a second protective coating;

wherein the current is pulsed direct current.

2. The method of claim 1 wherein the first protective coating comprises titanium dioxide and/or zirconium oxide.

3. The method of claim 1 wherein the first protective coating is comprised of titanium dioxide.

4. The method of claim 1 wherein said anodizing solution is maintained at a temperature of from 0° C. to 90° C. during step (D).

5. The method of claim 1 wherein the pulsed direct current has a peak voltage of 300-600 volts.

6. The method of claim 5 wherein said current is pulsed direct current having an average voltage of not more than 200 volts.

7. The method of claim 1 wherein during step (D) said protective coating is formed at a rate of at least 1 micron thickness per minute.

8. The method of claim 1 wherein said second protective coating comprises a topcoat comprising PTFE or silicone and at least one additional paint layer between the topcoat and the first protective coating.

9. The method of claim 1 wherein the anodizing solution is prepared using a complex fluoride selected from the group consisting of $H_2TiF_6$, $H_2ZrF_6$, $H_2HfF_6$, $H_2SnF_6$, $H_2GeF_6$, $H_3AlF_6$, $HBF_4$ and salts and mixtures thereof.

10. The method of claim 1 wherein the anodizing solution is additionally comprised of a phosphorus containing acid and/or salt.

11. The method of claim 1 wherein the anodizing solution is additionally comprised of a chelating agent.

12. The method of claim 1 wherein pH of the anodizing solution is adjusted using ammonia, an amine, an alkali metal hydroxide or a mixture thereof.

13. A method of forming a protective coating on a surface of a metallic article comprised predominantly of aluminum, said method comprising:

A) providing an anodizing solution comprised of water, a phosphorus containing acid and/or salt, and one or more additional components selected from the group consisting of water-soluble and water-dispersible complex fluorides and mixtures thereof, said fluorides comprising elements selected from the group consisting of Ti, Zr, Hf, Sn, Ge, B and combinations thereof;

B) providing a cathode in contact with said anodizing solution;

C) placing a metallic article comprised predominantly of aluminum as an anode in said anodizing solution;

D) passing a pulsed direct current, a non-pulsed direct current or an alternating current between the anode and the cathode for a time effective to form a first protective coating on the surface of the metal article;

E) removing the metal article having a first protective coating from the anodizing solution and drying said article; and F) applying one or more layers of paint to the metal article having a first protective coating, at least one of said layers comprising PTFE or silicone, to form a second protective coating;

wherein pulsed direct current passing between the anode and cathode has a peak voltage from 300 to 600 volts and wherein non-pulsed direct current or alternating current passing between the anode and cathode has an voltage of about 200 to about 600 volts.

14. The method of claim 13 wherein the anodizing solution is prepared using a complex fluoride comprising an anion comprising at least 4 fluorine atoms and at least one atom selected from the group consisting of Ti, Zr, and combinations thereof.

15. The method of claim 13 wherein the anodizing solution is prepared using a complex fluoride selected from the group consisting of $H_2TiF_6$, $H_2ZrF_6$, salts of $H_2TiF_6$, salts of $H_2ZrF_6$, and mixtures thereof.

16. The method of claim 13 wherein said complex fluoride is introduced into the anodizing solution at a concentration of at least 0.1 M.

17. The method of claim 13 wherein the direct current has an average voltage of not more than 250 volts.

18. The method of claim 13 wherein the anodizing solution is additionally comprised of a chelating agent.

19. The method of claim 13 wherein the anodizing solution is comprised of at least one complex oxyfluoride prepared by combining at least one complex fluoride of at least one element selected from the group consisting of Ti, Zr, and at least one compound which is an oxide, hydroxide, carbonate or alkoxide of at least one element selected from the group consisting of Ti, Zr, Hf, Sn, B, Al and Ge.

20. The method of claim 13 wherein the anodizing solution has a pH of from about 2 to about 6.

21. A method of forming a protective coating on an article having a metallic surface comprised of aluminum or aluminum alloy, said method comprising:

A) providing an anodizing solution, said anodizing solution having been prepared by dissolving a water-soluble complex fluoride and/or oxyfluoride of an element selected from the group consisting of Ti, Zr, Hf, Sn, Ge, B and combinations thereof and an inorganic acid or salt thereof that contains phosphorus in water;

B) providing a cathode in contact with said anodizing solution;

C) placing an article comprising at least one metallic surface comprised of aluminum or aluminum alloy as an anode in said anodizing solution;

D) passing a direct current or an alternating current between the anode and the cathode for a time effective to form a first protective coating on the at least one metallic surface;

E) removing the article comprising at least one metallic surface having a first protective coating from the anodizing solution and drying said article; and F) applying one or more layers of paint to the first protective coating, at least one of said layers comprising PTFE or silicone, to form a second protective coating;

wherein at least one compound which is an oxide, hydroxide, carbonate or alkoxide of at least one element selected from the group consisting of Ti, Zr, Hf, Sn, B, Al and Ge is additionally used to prepare said anodizing solution.

22. The method of claim 21 wherein pH of the anodizing solution is adjusted using ammonia, an amine, an alkali metal hydroxide or a mixture thereof.

23. The method of claim 21 wherein the current is pulsed direct current having an average voltage of not more than 125 volts.

24. The method of claim 21 wherein the anodizing solution is additionally comprised of a chelating agent.

25. A method of forming a protective coating on a surface of an article comprised of aluminum, said method comprising A) providing an anodizing solution, said anodizing solution having been prepared by combining one or more water-soluble complex fluorides of titanium and/or zirconium or salts thereof, a phosphorus containing oxy acid and/or salt and optionally, an oxide, hydroxide, carbonate or alkoxide of zirconium;

B) providing a cathode in contact with said anodizing solution;

C) placing an article comprised of aluminum as an anode in said anodizing solution; and D) passing a pulsed direct current, a non-pulsed direct current or an alternating current between the anode and the cathode for a time effective to form said protective coating on a surface of the article;

E) removing the article having a first protective coating from the anodizing solution and drying said article; and F) applying one or more layers of paint to the article having a first protective coating, at least one of said layers comprising PTFE or silicone, to form a second protective coating;

wherein pulsed direct current passing between the anode and cathode has a peak voltage from 300 to 600 volts and wherein non-pulsed direct current or alternating current passing between the anode and cathode has an voltage of about 200 to about 600 volts.

26. The method of claim 25 wherein one or more of $H_2TiF_6$, salts of $H_2TiF_6$, $H_2ZrF_6$, and salts of $H_2ZrF_6$ is used to prepare the anodizing solution.

27. The method of claim 25 wherein zirconium basic carbonate is used to prepare the anodizing solution.

28. The method of claim 25 wherein the one or more water-soluble complex fluorides is a complex fluoride of titanium and the current is direct current.

29. The method of claim 25 wherein the anodizing solution has been prepared by combining about 0.1 to about 1 weight percent zirconium basic carbonate and about 10 to about 16 weight percent $H_2ZrF_6$ or salt thereof in water and adding a base if necessary to adjust the pH of the anodizing solution to between about 3 and about 5.

30. A method of forming a protective coating on a surface of a metal article comprising aluminum or aluminum alloy, said method comprising:

A) providing an anodizing solution comprised of water and one or more additional components selected from the group consisting of:

a) water-soluble complex fluorides, b) water-soluble complex oxyfluorides, c) water-dispersible complex fluorides, and d) water-dispersible complex oxyfluorides of elements selected from the group consisting of Ti, Zr, Hf, Sn, Al, Ge and B and mixtures thereof;

B) providing a cathode in contact with said anodizing solution;

C) placing a metal article comprising aluminum or aluminum alloy as an anode in said anodizing solution;

D) passing a current between the anode and cathode through said anodizing solution for a time effective to form a first protective coating on the surface of the metal article;

E) removing the metal article having a first protective coating from the anodizing solution; and F) applying one or more layers of paint to the metal article having a first protective coating, at least one of said layers comprising PTFE or silicone, to form a second protective coating;

wherein the current is pulsed direct current.

31. The method of claim 30 wherein the first protective coating comprises titanium dioxide and/or zirconium oxide.

32. The method of claim 30 wherein the first protective coating is comprised of titanium dioxide.

33. The method of claim 30 wherein said current is pulsed direct current having an average voltage of not more than 200 volts.

34. The method of claim 30 wherein said pulsed direct current has a peak voltage of 350-550 volts.

35. A method of forming a protective coating on a surface of a metal article comprising aluminum or aluminum alloy, said method comprising:

A) providing an anodizing solution comprised of water and one or more additional components selected from the group consisting of:

a) water-soluble complex fluorides, b) water-soluble complex oxyfluorides, c) water-dispersible complex fluorides, and d) water-dispersible complex oxyfluorides of elements selected from the group consisting of Ti, Zr, Hf, Sn, Al, Ge and B and mixtures thereof;

B) providing a cathode in contact with said anodizing solution;

C) placing a metal article comprising aluminum or aluminum alloy as an anode in said anodizing solution;

D) passing a current between the anode and cathode through said anodizing solution for a time effective to form a first protective coating on the surface of the metal article;

E) removing the metal article having a first protective coating from the anodizing solution; and F) applying one or more layers of paint to the metal article having a first protective coating to form a second protective coating;

wherein the current is pulsed direct current.

36. The method of claim 35 wherein the first protective coating comprises titanium dioxide and/or zirconium oxide.

37. The method of claim 35 wherein the first protective coating is comprised of titanium dioxide.

38. The method of claim 37 wherein the anodizing solution is additionally comprised of a phosphorus containing acid and/or salt.

39. The method of claim 35 wherein the anodizing solution is prepared using a complex fluoride selected from the group consisting of $H_2TiF_6$, $H_2ZrV_6$, $H_2HfF_6$, $H_2SnF_6$, $H_2GeF_6$, $H_3AlF_6$, $HBF_4$ and salts and mixtures thereof.

40. The method of claim 35 wherein said current is pulsed direct current having an average voltage of not more than 200 volts.

41. The method of claim 35 wherein said pulsed direct current has a peak voltage of 300-600 volts.

42. The method of claim 35 wherein said pulsed direct current has an average voltage in a range of 75 volts to 250 volts.

* * * * *

UNITED STATES PATENT AND TRADEMARK OFFICE

CERTIFICATE OF CORRECTION

PATENT NO. : 7,569,132 B2
APPLICATION NO. : 10/972592
DATED : August 4, 2009
INVENTOR(S) : Shawn E. Dolan It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 138 days.

Signed and Sealed this

Seventh Day of September, 2010

David J. Kappos

David J. Kappos
*Director of the United States Patent and Trademark Office*